US008215475B2

(12) United States Patent
Schwarzbauer

(10) Patent No.: US 8,215,475 B2
(45) Date of Patent: Jul. 10, 2012

(54) APPARATUS AND METHOD FOR THE SEPARATION OF FLAT ARTICLES WITH WEAR COMPENSATION

(75) Inventor: Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 133 days.

(21) Appl. No.: 12/869,290

(22) Filed: Aug. 26, 2010

(65) Prior Publication Data

US 2011/0048896 A1 Mar. 3, 2011

(30) Foreign Application Priority Data

Aug. 27, 2009 (DE) ..... 10 2009 039 066

(51) Int. Cl.
*B65G 47/31* (2006.01)

(52) U.S. Cl. ..... 198/460.1; 198/626.3; 271/10.03

(58) Field of Classification Search ..... 198/460.1, 198/418.8, 418.9, 604, 606, 626.1, 626.3; 271/34, 111, 117, 118, 258.03, 256, 262, 271/10.03, 18, 256.04
See application file for complete search history.

(56) References Cited

U.S. PATENT DOCUMENTS

| | | | | |
|---|---|---|---|---|
| 6,494,310 | B1 * | 12/2002 | Furter | 198/606 |
| 6,729,593 | B2 * | 5/2004 | Kanen | 248/343 |
| 7,537,207 | B2 * | 5/2009 | Kutzer et al. | 271/34 |
| 8,020,863 | B2 * | 9/2011 | Konig et al. | 271/265.04 |
| 8,042,677 | B2 * | 10/2011 | Konig et al. | 198/460.1 |
| 8,113,337 | B2 * | 2/2012 | Schererz et al. | 198/460.1 |
| 2007/0252321 | A1 | 11/2007 | Kutzer et al. | |
| 2008/0211168 | A1 | 9/2008 | Kutzer et al. | |

FOREIGN PATENT DOCUMENTS

| | | | |
|---|---|---|---|
| DE | 10350623 | B3 | 4/2005 |
| DE | 102007007813 | B3 | 1/2008 |

* cited by examiner

*Primary Examiner* — James R Bidwell
(74) *Attorney, Agent, or Firm* — Laurence A. Greenberg; Werner H. Stemer; Ralph E. Locher

(57) ABSTRACT

An apparatus and method separate flat articles, in particular flat mail consignments, and have built-in wear compensation. The apparatus possesses a transport element, a retention element, a displaceable mounted base and a range sensor. Either the transport element or the retention element is mounted on the base. The other element is mounted fixedly. The transport element is moved in relation to the retention element, with the result that overlapping articles are drawn apart from one another. The range sensor measures the length of a section from a fixed point to such a surface of the transport element which comes into contact with articles. In dependence on the measured section length, the base is displaced in such a way that the displacement of the base compensates for abrasion of the transport element.

9 Claims, 4 Drawing Sheets

APPARATUS AND METHOD FOR THE SEPARATION OF FLAT ARTICLES WITH WEAR COMPENSATION

CROSS-REFERENCE TO RELATED APPLICATION

This application claims the priority, under 35 U.S.C.§119, of German application DE 10 2009 039 066.9, filed Aug. 27, 2009; the prior application is herewith incorporated by reference in its entirety.

BACKGROUND OF THE INVENTION

Field of the Invention

The invention relates to an apparatus and a method for the separation of flat articles, in particular of flat mail consignments.

German patent DE 10 2007 007 813 B3, corresponding to U.S. patent publication No. 2008/0211168, describes an apparatus and a method for separating flat articles by use of a plurality of separation steps. Each separation step possesses in each case a transport element for driving the articles and a retention element for retaining the articles. In a separation mode, the articles are transported between the transport element and the retention element and are thereby separated.

The retention element or else the transport element is fastened on a movable holding device. The other element is fastened fixedly. In the event of a build-up of articles, the separation step is stopped and the holding device is displaced, so that the distance between the transport element and the retention element is increased. The build-up can be eliminated, and the original distance is then restored.

German patent DE 103 50 623 B3, corresponding to U.S. Pat. No. 7,537,207, describes an apparatus and a method for the separation of flat articles. The flat articles, mail consignments in DE 103 50 623 B3, are transported upright and in a stacked position on a pair of draw-off rockers and are drawn off laterally by an underfloor belt in cooperation with the draw-off rockers. The mail consignments are transported via a transport path which is delimited, on one side, by two series-connected endless conveyer belts 13, 14 and, on the other side, by a continuous retention element 19.

SUMMARY OF THE INVENTION

It is accordingly an object of the invention to provide an apparatus and a method for the separation of flat articles with wear compensation which overcome the above-mentioned disadvantages of the prior art methods and devices of this general type, which prevent the situation in which wear of the transport element due to the fact that articles are drawn apart from one another markedly increases the error rate of the separation apparatus.

With the foregoing and other objects in view there is provided, in accordance with the invention an apparatus for separating flat articles extending in an article plane. The apparatus contains a transport element, a retention element, a controller, a drive for the transport element, a displaceably mounted base, and an actuating drive for displacing the base. One of the transport element and the retention element is mounted on the base. The controller is configured for activating the actuating drive such that the actuating drive displaces the base such that a distance between the transport element on the base and the retention element is varied. The apparatus is configured for introducing each of the flat articles to be separated between the transport element and the retention element such that an article comes into contact with a surface of the transport element. The drive is configured for driving the transport element such that the transport element is moved in relation to the retention element, and as a result of the relative movement, a drawing apart of at least partially overlapping articles disposed between the transport element and the retention element is brought about. The transport element is configured such that contact between the surface of the transport element and the article to be separated causes abrasion of particles from the surface of the transport element. A range sensor is configured for measuring a length of a section from a fixed point to the surface of the transport element coming into contact with the articles during the drawing apart. The controller is configured for activating the actuating drive in dependence on a measured section length in such a way that the actuating drive displaces the base in such a way that displacement of the base completely or at least partially compensates for the abrasion of the particles from the surface of the transport element.

The apparatus according to the solution contains a transport element, a retention element, a displaceably mounted base, a drive for the transport element, an actuating drive for displacing the base, a range sensor, and a controller.

Each flat article to be separated is introduced between the transport element and the retention element. It is possible that a plurality of articles overlap one another at least temporarily. Each article to be separated comes into contact with a surface of the transport element during separation. It is possible that different articles come into contact with different regions of the surface.

Either the transport element or the retention element is mounted on the base, and the other element is mounted fixedly. The drive is configured for driving the transport element in such a way that the transport element is moved in relation to the retention element, and as a result of this relative movement, a drawing apart of at least partially overlapping articles is brought about.

During separation, in each case a region of a surface of the transport element and also a region of a surface of the retention element come into mechanical contact with each article. This contact of the moving transport element has the effect that particles are abraded from this surface region of the transport element. The transport element is thus worn by abrasion ("abrasive wear"). The transport element thereby becomes thinner.

The range sensor is configured for directly or indirectly measuring the length of a section from a fixed point to such a surface of the transport element which comes into contact with articles during drawing apart. The controller is configured for activating the actuating drive as a function of the measured section length in such a way that the actuating drive displaces the base in such a way that the displacement of the base completely or at least partially compensates the abrasion of particles from the surface of the transport element.

Complete compensation means that the distance between such a surface of the transport element which faces the articles to be separated and the retention element remains the same. A fixed point on the base is displaced toward a fixed point as a result of displacement.

In partial compensation, the distance between the transport element and the retention element remains at least approximately constant.

The apparatus according to the solution automatically compensates wear of the transport element due to abrasion. It is not necessary to readjust the apparatus according to the solution manually, which always entails costs and is possibly neglected completely or carried out wrongly on account of human error. The displaceable base with the transport element or with the retention element is displaced as a function of an actually measured section length which varies on account of the abrasion. It is not necessary to displace this element as a function of other parameters, for example of the operating time or of the number of separated articles. The measured section length is a better measure of the wear than the operating time or the number of articles.

Preferably, the base is displaced such that displacement just compensates the wear, in that the displacement exactly compensates the variation in the measured section length. This refinement allows an especially simple control, since, in this control, a controller merely needs to keep the section length constant and does not have to take into account any compensation factor. The range sensor merely needs to measure accurately in a narrow region around a desired section length and, outside the region, simply needs to signal whether the actual section length is larger or smaller than the desired value.

Preferably, the range sensor measures the length of a section not interrupted by articles which are to be separated. It thereby becomes possible that the range sensor measures the section continuously, even during running the separation operation, and without an article interrupting a light beam along the section.

In one refinement, a measuring lever bears constantly against the transport element. Wear of the transport element has the effect that the measuring lever is pivoted. This pivoting is measured. This refinement avoids the need for placing the section to be measured in such a way that the section to be measured terminates on the surface of the transport element. The surface of the measuring lever can be lined with a reflecting layer or be made from a suitable material, so that range measurement is simplified.

Other features which are considered as characteristic for the invention are set forth in the appended claims.

Although the invention is illustrated and described herein as embodied in an apparatus and a method for the separation of flat articles with wear compensation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
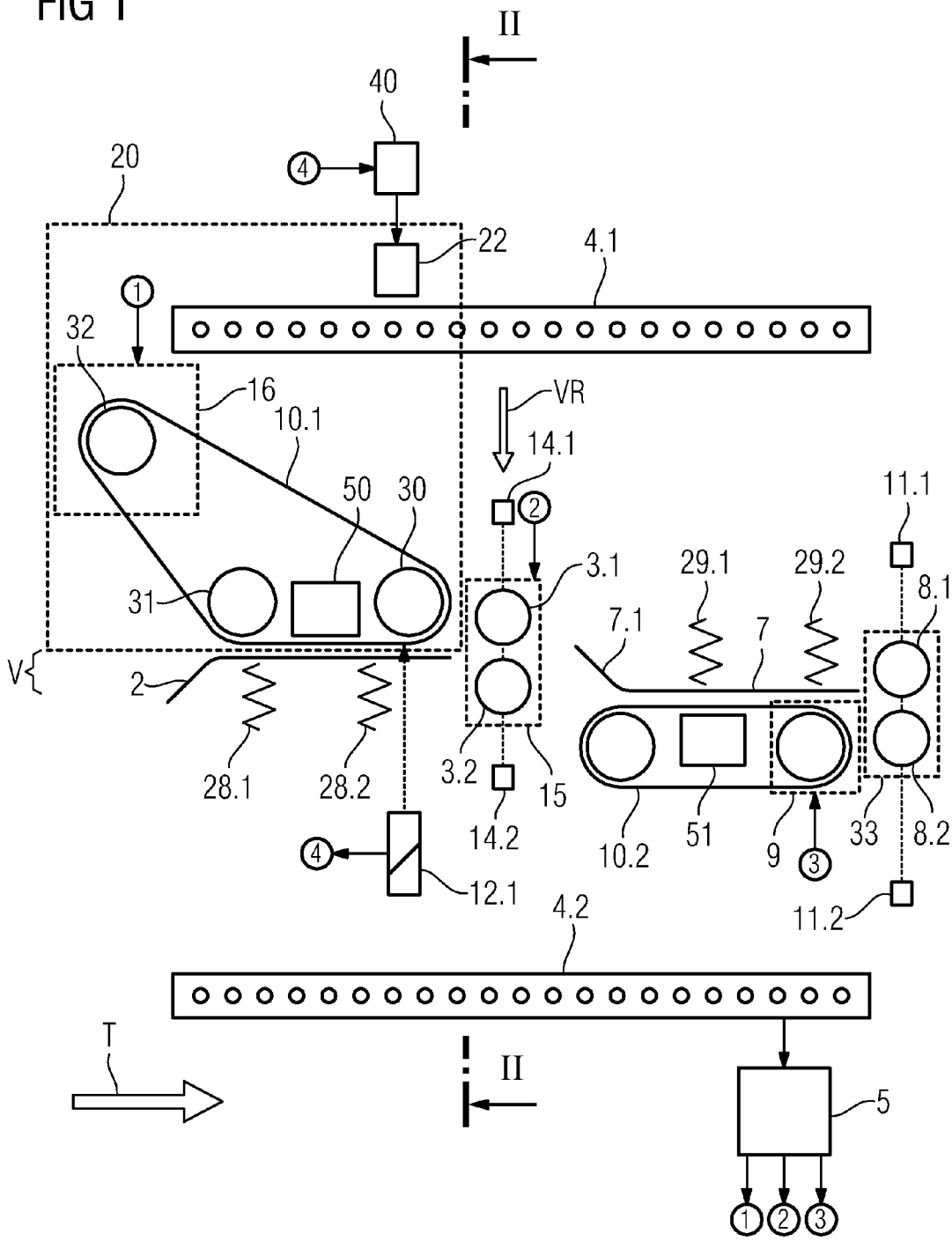
FIG. 1 is a diagrammatic, top view of an apparatus of an exemplary embodiment according to the invention.

In the exemplary embodiment, the apparatus according to the solution is used for separating flat mail consignments. Each mail consignment extends in an article plane. The mail consignments are transported in a random arrangement to the apparatus. The mail consignments run, upright, through the apparatus. The article plane of each article therefore stands approximately vertically. Preferably, each article slides with a lower edge over a base.

The mail consignments are processed by a sorting plant with the aim of sorting the mail consignments in dependence on their respective delivery address. For this purpose it is necessary to decipher the delivery address of each mail consignment and to discharge the mail consignment into a sorting output point of the sorting plant as a function of the delivery address. The apparatus according to the solution in the exemplary embodiment is used for separating the mail consignments in such a way that the mail consignments can then be aligned and oriented, the respective delivery address can subsequently be deciphered, and the mail consignments can be discharged correctly.

The apparatus possesses two series-connected separators. Each separator contains in each case a transport element (driving element), a drive for the transport element, a retention element, a draw-forward element, and a drive for the draw-forward element.

The same motor may drive the drives of both transport elements and both draw-forward elements. Preferably, however, the transport element and the draw-forward element of each separator have in each case a specific drive, so that each separator can be activated separately and can transport or stop mail consignments separately.

The mail consignments are transported through between the transport element and the retention element of the first separator, then by the draw-forward element of the first separator, subsequently between the transport element and the retention element of the second separator, and finally by the draw-forward element of the second separator. During transport both the transport element and the retention element of each separator, over a large area, bear against the mail consignment, which is to say over the entire length of the mail consignment or over a considerable part of the mail consignment length. Better separation than when only two rollers come to bear is thereby achieved. During separation, therefore, each mail consignment bears temporarily over a large area against the transport element and temporarily over a large area against the retention element.

Both each transport element and each retention element possess a high-grip surface, so that a sufficiently high coefficient of friction occurs in each case between a mail consignment and the transport element and between the mail consignment and the retention element, specifically both with regard to static friction and with regard to sliding friction. The term "coefficient of friction" is defined, for example, in Dubbel, Taschenbuch fur den Maschinenbau, [Handbook of Mechanical Engineering], 18th edition, section B15. The frictional force is equal to the product of the transverse force and coefficient of friction.

The coefficient of friction between a transport element and a mail consignment is higher than the coefficient of friction between a retention element and the mail consignment. The coefficient of friction between the retention element and the mail consignment is higher than the coefficient of friction between two mail consignments adhering to one another.

In the exemplary embodiment, each transport element contains a plurality of endless conveyer belts lying one above the other, which are guided around at least two rollers and are referred to below as "driving conveyer belts". Each of these rollers is mounted rotatably on a vertical shaft or a vertical axis. Preferably, exactly one roller, around which a driving conveyer belt of a transport element is guided, is driven, and the other rollers are configured as running rollers. In the exemplary embodiment, all the driving conveyer belts of a transport element are guided around the same three rollers. A slot occurs in each case between two driving conveyer belts lying one above the other.

Preferably, that surface of the transport element which faces the mail consignment to be separated is constructed from a rubber-like material. In the embodiment with the endless conveyer belt, each endless conveyer belt possesses an outwardly pointing surface which is manufactured from a rubber-like material.

In the exemplary embodiment, the retention element contains a plurality of fixed components. Each of these components contains a straight element. The straight element bears over a large area against a mail consignment. The fixed components of a retention element are arranged one above the other. In order to keep the components in position, the fixed components lying one above the other lie on a rake of a belt support. The belt support is mounted fixedly, for example on a separator base plate. Furthermore, each fixed component contains a bent deflecting component.

In another refinement, each retention element also contains in each case at least one endless conveyer belt which is referred to below as a "retention conveyer belt". The endless conveyer belt is guided around running rollers which are likewise mounted on vertical shafts.

In one refinement, each driving conveyer belt, that is to say each endless conveyer belt or transport element, has projections which engage into matching clearances of the opposite retention element, for example into a slot between two fixed components lying one above the other. These projections and clearances extend in the longitudinal direction along the transport direction and are configured, for example, as horizontal continuous lines. It is also possible that the retention element has projections which engage into clearances of the transport element.

In the exemplary embodiment, the transport element of each separator contains a plurality of driving conveyer belts which lie one above the other and which engage into slots in each case between two fixed components of the matching retention element which lie one above the other, without the driving conveyer belts and fixed components touching one another. A mail consignment transported through between the transport element and the retention element thereby temporarily acquires a contour in the form of a wavy line, as seen in the transport direction. The driving conveyer belts and fixed retention components form two saw-tooth lines.

In one refinement, each separator additionally contains a suction-intake device. This suction-intake device sucks in air. The air flows through clearances in each driving conveyer belt of the transport element and generates a vacuum. The vacuum draws an object (an individual mail consignment or a plurality of overlapping mail consignments) toward the driving conveyer belts and increases the transverse force, and therefore the frictional force which acts between each driving conveyer belt and the mail consignment, upon the mail consignment. It is also possible that the suction-intake device generates a vacuum between the retention element and the mail consignment.

In the exemplary embodiment, a sequence of clearances in the form of holes is introduced into each driving conveyer belt. Preferably, these clearances extend over the entire length of a driving conveyer belt. A suction-intake device which bears against the driving conveyer belt sucks air in through these clearances when the clearances are led past a suction-intake chamber of the suction-intake device. No air is sucked into the slot between two adjacent driving conveyer belts.

The transport rollers of the draw-forward elements are driven in opposite directions of rotation.

The mail consignments are transported, upright, to the first separator. Each flat mail consignment therefore stands on an edge. An under floor conveyer belt transports the upright mail consignments in the transport direction which lies parallel to the article planes or which stands perpendicularly to these article planes.

In one refinement, a stack of flat mail consignments is transported toward the first separator perpendicularly to their article planes. In another refinement, the mail consignments are transported to the first separator in a direction parallel to their article planes, a plurality of mail consignments as a rule partially overlapping one another. In this context, "overlapping" is to be understood as meaning in a direction perpendicular to the article planes of the flat mail consignments.

The mail consignments, even the overlapping ones, come between the transport element and the retention element of the first separator. The transport element of the first separator drives overlapping mail consignments. For example, the mail consignments adhere to the driving conveyer belts and are moved toward the first transport element by the retention element.

Since the coefficient of friction between a mail consignment and the retention element is higher than the coefficient of friction between two overlapping mail consignments, the first separator draws overlapping mail consignments apart from one another. In order to bring this about, the transport element moves faster than the retention element of the first separator, so that a relative speed of the transport element in relation to the retention element occurs. In the exemplary embodiment, the retention element does not move at all. Since the coefficient of friction and therefore the frictional force between a mail consignment and the transport element is even higher, preferably no slip occurs between the mail consignment and the transport element. The vacuum reinforces this effect.

In the exemplary embodiment, each separator possesses, furthermore, a draw-forward element with two driven transport rollers. The two transport rollers are rotated at the same rotational speed in different directions of rotation. At each contact point, the two transport rollers give rise to the same transport vector. These two transport rollers possess in each case a high-grip outer surface and are seated on parallel and driven rollers. The draw-forward element is arranged downstream of the transport element and retention element of the separator.

In the exemplary embodiment, the transport rollers are sprung in such a way that compression springs press the two transport rollers against one another, but a mail consignment can press the transport rollers apart when the two transport rollers grasp the mail consignment and draw it forward.

Furthermore, the first separator possesses the first draw-forward element with the two transport rollers, which is arranged downstream of the transport element and of the retention element. A mail consignment is transported between these two transport rollers, the two transport rollers temporarily grasping the mail consignment. As soon as the leading edge of a mail consignment is grasped by the two transport rollers, the transport element and retention element are stopped. The transport rollers draw a mail consignment forward between the transport element and retention element. If this mail consignment overlaps partially with a following mail consignment, the transport rollers grasp only the leading mail consignment, but not the following mail consignment.

The following mail consignment is retained by the transport element and the retention element. As soon as it is established that the trailing edge of the leading mail consignment has passed the transport rollers, at least the transport element is rotated again and transports the following mail consignment toward the transport rollers. The first separator thus performs a start/stop operation. The transport element is continually started and stopped again. By contrast, the transport rollers of the draw-forward element are rotated continuously.

A light barrier or another suitable sensor measures the events in which a leading edge of a mail consignment has reached the two transport rollers of the first separator and in which the trailing edge has passed the transport rollers. The mail consignment interrupts the light beam which the transmitter of the light barrier has emitted.

In one refinement, an individual mail consignment which is transported by the transport element of the first separator co-rotates the retention element. In another refinement, the retention element is stationary. By contrast, two overlapping mail consignments are drawn apart from one another as a result of the cooperation of the transport element and retention element.

The second separator preferably works in the same way, as long as the second separator likewise operates in the separation mode.

Preferably, the transport element of the second separator is arranged on the other side of that transport path via which the mail consignments are transported, as compared with the transport element of the first separator. If, therefore, the transport element of the first separator is arranged on the left of the transport path, as seen in the transport direction, the transport element of the second separator is located on the right of the transport path. Correspondingly, the retention elements of the two separators are also mounted on different sides of the transport path.

This refinement brings about improved separation. To be precise, the following is possible: two mail consignments partially overlap one another before they reach the first separator. The leading mail consignment bears against the retention element of the first separator and the following mail consignment against the transport element of the first separator. The transport element can transport the following mail consignment forward in relation to the leading mail consignment and thereby bring about separation. It may happen, however, that the following mail consignment drawn forward is caught in a flap or viewing window or similar component of the leading mail consignment and cannot be drawn forward any further, so that the first separator cannot separate these two mail consignments.

By contrast, in this configuration, the second separator will draw the leading mail consignment forward in relation to the following mail consignment and thereby bring about separation. The catch between the two mail consignments comes loose automatically in that the second separator introduces forces on another side of the object composed of the caught mail consignments, as compared with the first separator.

Each upright mail consignment is therefore drawn forward on one surface by a transport element and is retained on the other surface by a retention element. Slip in this case necessarily occurs between the mail consignment and the transport element. The surface of the transport element is manufactured from a material having a high coefficient of friction, for example from a rubber-like material. The slip has the effect that particles are abraded from that surface of the transport element which comes into contact with the mail consignments to be separated. This abrasion ("abrasive wear") causes the transport element to become worn and, over time, to become thinner. In the exemplary embodiment, each endless conveyer belt will become thinner over time.

The two separators are shown by way of example in FIG. 1. The first separator contains a driven first transport element 10.1, which is composed of a plurality of driving conveyer belts lying one above the other, and a first retention element 2. Two compression springs 28.1, 28.2 press the first retention element 2 against the driving conveyer belts of the first transport element 10.1 to an extent such that only a predetermined minimum distance remains between the transport element 10.1 and the retention element 2.

FIG. 1 shows, furthermore, a first draw-forward element 3 with the two transport rollers 3.1, 3.2 which lie downstream of the first transport element 10.1 and the first retention element 2, a light barrier 14 with a transmitter 14.1 and with a receiver 14.2, and a control device 5.

A mail consignment which is transported by the first transport element 10.1 is grasped by the transport rollers 3.1, 3.2 and transported to the second separator. The light barrier 14 measures when the leading edge of the mail consignment has reached the transport rollers 3.1, 3.2. Preferably, the transmitter 14.1 emits a light beam located in that plane which is defined by the two mid-axes of the transport rollers 3.1, 3.2.

A drive motor 15 rotates the transport roller 3.1 or both transport rollers 3.1, 3.2 of the first draw-forward element 3. In one refinement, the transport rollers 3.1, 3.2 rotate at the same speed as the driving conveyer belts of the first transport element 10.1.

The control device 5 activates the drive motors for the transport elements and draw-forward elements of the two separators and thereby causes this start/stop operation. The light barriers transmit signals to the control device 5 and the control device 5 processes these signals.

In the exemplary embodiment, the driving conveyer belts of the first transport element 10.1 are guided around three rollers, 30, 31 and 32. A drive motor 16 rotates the roller 32 and therefore the first transport element 10.1. The control device 5 can switch on the two drive motors 15, 16 and switch them off again.

Furthermore, the first separator contains a suction-intake chamber 50. Each driving conveyer belt of the first transport element 10.1 is led past an orifice of the suction-intake chamber 50. The suction-intake chamber 50 sucks in air through this orifice and through clearances in the driving conveyer belts of the transport element 10.1.

Figure 2:
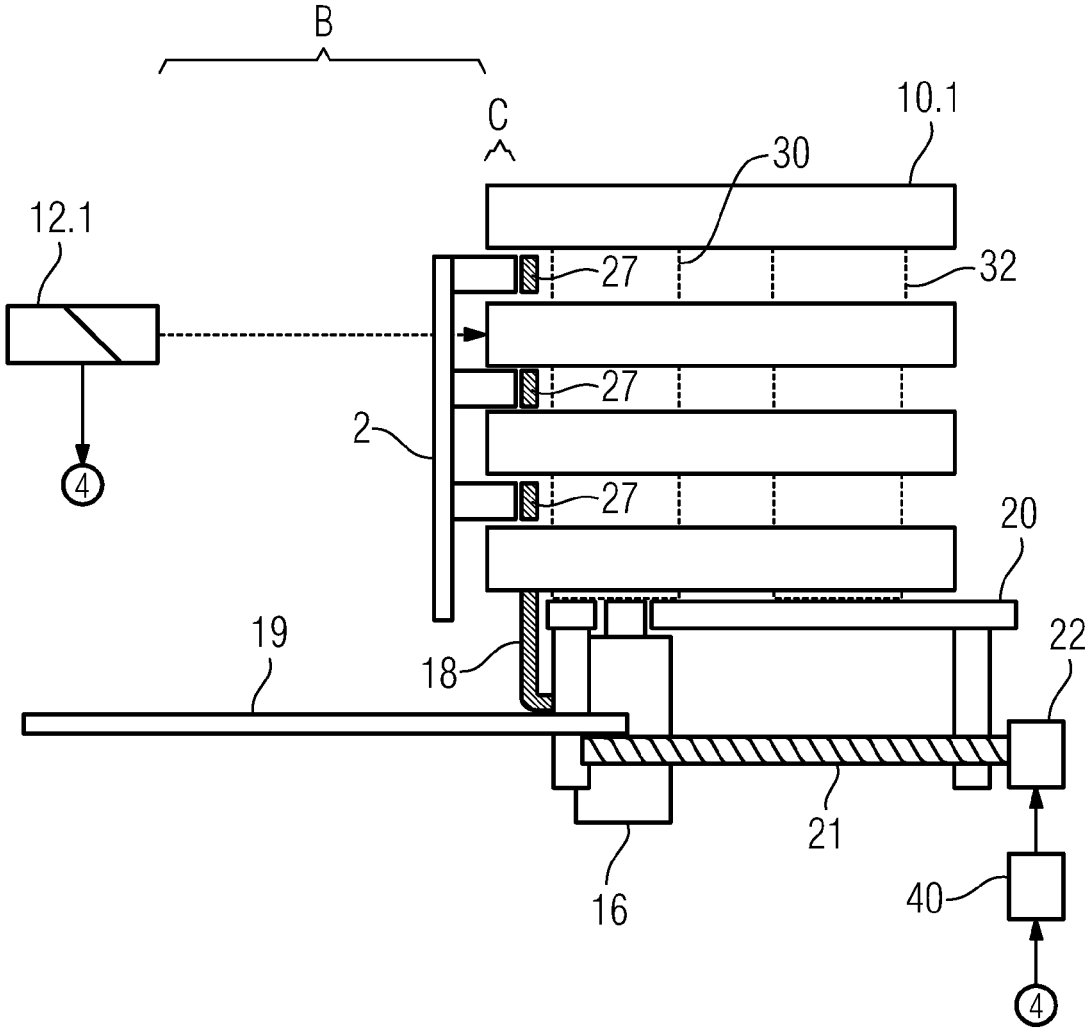
FIG. 2 is a sectional view of a first separator taken along the plane II-II shown in FIG. 1.

FIG. 2 shows in detail, and in the plane II-II of FIG. 1, that the first transport element 10.1 is composed of a plurality of individual driving conveyer belts lying one above the other. The first retention element 2 possesses a plurality of fixed components which are arranged one above the other and between which lies a rake 27 of a belt support 18. The individual components of the first retention element 2 run in each case over a projection of the rake 27. The first retention element 2 possesses projections which bear against a mail consignment.

The driving conveyer belts of the first transport element 10.1 project at a distance C beyond the projections from the first retention element 2. The first retention element 2 is mounted on a separator base plate 19. In an embodiment already presented, the first retention element 2 contains a plurality of fixed components which are arranged one above the other and lie on the rake 27 of the belt support 18. The belt support 18 is mounted fixedly on the separator base plate 19.

The three rollers 30, 31, 32 around which the driving conveyer belts of the first transport element 10.1 are guided, are mounted on a mounting plate 20. The mounting plate 20 is preferably mounted movably in such a way that an actuating drive 22 can displace the mounting plate 20 in a displacement direction VR perpendicularly to a transport direction T and perpendicularly to the transport path, see FIG. 1. By contrast the separator base plate 19 is mounted fixedly. Since the mounting plate 20 can be displaced in relation to the separator base plate 19, the distance between the first transport element 10.1 and first retention element 2 can be varied, with the result that wear of the first transport element 10.1 can be compensated.

Preferably, the actuating drive 22 rotates at least two toothed belts, and these toothed belts rotate at least two spindles. These spindles engage into matching fastening elements of the mounting plate 20. A rotation of spindles 21 has the effect that the mounting plate 20 executes a linear movement, specifically perpendicularly to the transport direction T in which the first separator transports mail consignments. The actuating drive 22 is activated by the control device 5 and can rotate the spindles 21.

The second separator contains the following components shown in FIG. 1:

- a driven transport element 10.2 (the second transport element) in the form of a plurality of endless conveyer belts lying one above the other,
- a drive motor 9 for the second transport element 10.2,
- a retention element 7 (the second retention element) in the form of a plurality of fixed components arranged one above the other,
- a draw-forward element 8 with two driven transport rollers 8.1, 8.2,
- a drive motor 33 for the transport rollers 8.1, 8.2,
- a light barrier 11 with a transmitter 11.1 and with a receiver 11.2 and
- a suction-intake chamber 51.

An arrangement with a plurality of compression springs 29.1, 29.2 presses the second retention element 7 against the driven second transport element 10.2.

The two transport rollers 8.1, 8.2 of the second draw-forward element 8 draw the separated mail consignments forward between the second transport element 10.2 and the second retention element 7.

In the exemplary embodiment, the transport element 10.1 of the first separator is arranged on the left of the conveying path, as seen in the transport direction T, the transport element 10.2 of the second separator being arranged on the right of the conveying path.

In the exemplary embodiment, the second separator can be switched to and fro between two modes, to be precise a separation mode and a transport mode.

In the exemplary embodiment, the second separator possesses the light barrier 11 with the transmitter 11.1 and with the receiver 11.2. The light barrier 11 detects whether the leading edge of an "object" has reached the transport rollers 8.1, 8.2. The term "object" designates both an individual mail consignment and a plurality of mail consignments which overlap one another partially or completely.

In the separation mode, the second separator performs in start/stop operation in exactly the same way as the first separator. The second transport element 10.2 transports an object as far as the transport rollers 8.1, 8.2 of the second draw-forward element 8. As soon as the leading edge of this object has reached the transport rollers 8.1, 8.2, the second transport element 10.2 is stopped. The transport rollers 8.1, 8.2, which continue to be driven, draw the leading mail consignment forward between the second transport element 10.2 and the second retention element 7. The second transport element 10.2 and the second retention element 7 retain a following mail consignment. As a result, overlapping mail consignments are drawn apart and separated from one another.

In the transport mode, the second separator transports a mail consignment without being stopped and without exerting a separating action. The second transport element 10.2 therefore transports an object further on even when its leading edge has reached the transport rollers 8.1, 8.2.

The second separator is operated in the transport mode until it is established that the first separator has not completely separated two overlapping mail consignments. Only then is the second separator changed over to the separation mode and separates these overlapping mail consignments. As soon as all these separated mail consignments have left the second separator completely, the second separator is changed over to the transport mode again.

The second separator is changed over from the transport mode to the separation mode when it is established that an object in the second separator is composed of a plurality of overlapping mail consignments and the leading edge of this object, that is to say the leading edge of the foremost mail consignment, has reached the transport rollers 8.1, 8.2. The light barrier 11 detects when the transport rollers 8.1, 8.2 are reached. Preferably, the second separator is changed over exactly at this moment of reaching the transport rollers 8.1, 8.2. The foremost mail consignment is transported to an extent such that the transport rollers 8.1, 8.2 reliably grasp this foremost mail consignment.

The second separator is changed over from the transport mode to the separation mode in that the control device 5 stops the drive motor 9 of the second transport element 10.2. The transport rollers 8.1, 8.2 then draw the leading mail consignment forward between the second transport element 10.2 and the second retention element 7 which are both stopped. The following mail consignment is retained by the second transport element 10.2 and by the second retention element 7.

The situation is preferably prevented where further mail consignments are transported into the second separator until the second separator eliminates the detected double draw-off. This is prevented in that the entire first separator is additionally stopped temporarily. The control device 5 therefore stops the drive motors 16 (for the first transport element 10.1) and 15 (for the first draw-forward element 3). This stopping of the first separator is preferably carried out simultaneously with the step of changing over the second separator to the separation mode. Only when all the previously overlapping mail consignments have left the second separator completely does the control device 5 start the first separator again. Preferably, the control device 5 at the same time changes over the second separator to the transport mode again.

A light barrier detects that time point at which the trailing edge of the leading, then separated mail consignment has passed the light barrier and therefore a gap occurs between the leading and the then following mail consignment. The light barrier may be the light barrier 11 or a light barrier of the light barrier arrangement 4 described further below or a further light barrier which is arranged downstream of the light barrier 14. The discovery of the gap triggers the steps in which the control device 5 changes over the second separator to the transport mode again and switches the drive motor 9 on again. The second transport element 10.2 transports mail consignments continuously to the transport rollers 8.1, 8.2. Moreover, the first separator resumes its start/stop operation. For this purpose, the control device 5 starts the drive motors 16 (for the first transport element 10.1) and 15 (for the first draw-forward element 3) again.

The second separator therefore performs in start/stop operation only when a double draw-off is detected, and otherwise works in a continuous transport mode. A markedly higher throughput is thereby achieved. Moreover, start/stop operation, which is susceptible to wear, is reduced to the necessary minimum.

In order automatically to distinguish whether an object in the second separator is an individual mail consignment or is composed of a plurality of partially overlapping mail consignments, the apparatus contains, furthermore, a light barrier arrangement 4. The light barrier arrangement 4 possesses a transmitter row 4.1 with a plurality of transmitters and a receiver row 4.2 with a plurality of receivers, which are arranged one behind the other.

In one refinement, the transmitter row 4.1 and the receiver row 4.2 extend over the length of the entire first separator and of the entire second separator. In the minimum embodiment, the light barrier arrangement 4 monitors at least the second transport element 10.2 and the second retention element 7.

The transmitter row 4.1 contains at least one series with a multiplicity of transmitters which emit parallel light beams. Correspondingly, the receiver row 4.2 contains at least one series with a multiplicity of receivers which receive the light beams from the transmitters. It is possible that the transmitter row 4.1 and the receiver row 4.2 contain in each case a plurality of individual rows arranged one above the other. The light barrier arrangement 4 can thereby detect different mail consignments having different heights.

Each mail consignment interrupts each light beam from a transmitter if the light beam impinges onto the mail consignment. A light beam from a transmitter which is not interrupted by a mail consignment impinges onto the corresponding receiver.

A sequence of measurement time points is predetermined. The time interval between two successive measurement time points is, for example, varied inversely proportionally to the transport speed of the second separator or remains constant. The time interval is so small that a plurality of measurement time points come within each period of time in which a mail consignment runs through the second separator.

At each measurement time point, each receiver of the receiver row 4.2 delivers exactly one of the two possible signals "light beam impinged on receiver" or "no light beam impinged", that is to say a light beam interrupted by a mail consignment. As a result, a sequence of objects in the second separator is discovered for each measurement time point, an object being composed of an individual mail consignment or of a plurality of at least partially overlapping mail consignments. In each case a gap, through which at least one light beam passes, is located in each case between two successive objects.

Each object interrupts at least one light beam. The distance between two successive gaps is identical to the length of the transported object between these two gaps. The gap distance is calculated approximately as the distance between the two receivers of the receiver row 4.2 onto which a light beam impinges in each case.

The receiver row 4.2 transmits measurement signals to the control device 5. The control device 5 evaluates these measurement signals and decides whether an object composed of a plurality of overlapping mail consignments is being transported in the second separator or not.

While an object composed of a plurality of mail consignments is being transported through the second separator, an additional gap may occur in this object, to be precise because two previously overlapping mail consignments of the object are drawn apart from one another as a result of cooperation of the second transport element 10.2 and of the second retention element 7. This drawing apart is brought about in that the second transport element 10.2 and the second retention element 7 are activated such that a relative speed between these elements 10.2 and 7 occurs and the second transport element 10.2 is moved faster than the second retention element 7.

The light barrier arrangement 4 therefore measures the length of the same object at at least two measurement time points while the second separator is in the transport mode and the second transport element 10.2 is transporting this object toward the transport rollers 8.1, 8.2 of the second drawforward element 8.

Preferably, a relative speed occurs between the second transport element 10.2 and the second retention element 7. For example, the second retention element 7 is not driven, but, instead, is co-rotated by mail consignments, or is composed of fixed components. As a result, a plurality of overlapping mail consignments are drawn apart, and an object composed of a plurality of mail consignments varies its length while it is being transported through the second separator.

If the length of the object varies during transport, the object is composed of a plurality of overlapping mail consignments.

In this case, the second separator is changed over to the separation mode as soon as the leading edge of the object reaches the light barrier 11. This leading edge is formed by the leading edge of the leading mail consignment of the object. The retention element 7 and the transport element 10.2 of the second separator retain each following mail consignment of the object.

Instead of a light barrier arrangement 4, the second separator may also have a camera which generates a lateral image of the object. The contour of the object in the image is evaluated. If this contour has a plurality of rectangles, the object contains a plurality of mail consignments. This refinement avoids the need to generate a relative speed between the second transport element 10.2 and the second retention element 7.

Preferably, the transport path through which the mail consignments run is composed of two straight sections and of a curved transition region. The first straight section is formed by the first transport element 10.1 and the first retention element 2 of the first separator, and the second straight section is formed by the second transport element 10.2 and the second retention element 7 of the second separator. The second straight section is offset laterally in relation to the first section, so that the transition region is curved, specifically curved preferably in an S-shaped manner. The lateral offset V is illustrated, exaggerated in FIG. 1.

The first separator can draw articles apart from one another in a first drawing-apart plane. The second separator can draw articles apart from one another in a second drawing-apart plane. In the exemplary embodiment, these two drawing-apart planes are arranged parallel to one another and are at a distance V from one another. The element 7.1 functions as a deflecting element. When an article is transported from the first separator to the second separator, the deflecting element 7.1 deflects this article from the first drawing-apart plane into the second. The deflecting element 7.1 is preferably composed of a plurality of deflecting components lying one above the other, here of the curved components of the second retention element 7.

In one modification, the two drawing-apart planes meet one another at an acute angle. As a result, the two drawing-apart planes intersect in a straight line. When a mail consignment is transported from the first separator to the second separator, the mail consignment is rotated about an axis of rotation which lies parallel to this intersection straight line. This rotation often additionally improves the separating action.

If two overlapping mail consignments run through this curved region, the leading edge of the leading mail consignments is already grasped by the second separator located downstream and the trailing edge of the following mail consignment is still grasped by the first separator located upstream. As a result, the distances between the leading edges and/or the trailing edges may vary, and a distance and/or offset between the two mail consignments occur/occurs. The effect of this is that the mail consignments are separated by the second separator more easily.

In a preferred refinement, the wear, caused by abrasion, of the driving conveyer belts in the transport elements 10.1, 10.2 and/or the components of the retention elements 2, 7 is monitored, and at least one element is readjusted automatically. This readjustment is illustrated in FIG. 1 to FIG. 4 by way of example for the first transport element 10.1 of the first separator.

As already stated, the separation of the mail consignments has an effect that slip occurs between the transport element and a mail consignment to be separated. The result of this slip is that particles are abraded from those surfaces of the endless conveyer belts of the transport element 10.1 which are in contact with mail consignments to be separated. This abrasion of particles makes the endless conveyer belts of the first transport element 10.1 thinner. As a result, the section C decreases by the amount by which the endless conveyer belts of the first transport element 10.1 project out of the belt support 18 of the first retention element 2, see FIG. 2. Moreover, the distance between the rake 27 of the first retention element 2 and the surface of the endless conveyer belts of the first transport element 10.1 increases.

These distance variations are compensated according to the solution.

A range sensor 12.1, 12.2, 12.3 measures continually the distance between itself and that surface of the first driving conveyer belt 10.1 which faces the mail consignments to be separated.

The mounting plate 20 with the first transport element 10.1 is displaced transversely to the transport direction toward the first retention element 2 in the displacement direction VR. The distance between the first transport element 10.1 and the first retention element 2 is thereby varied.

The distance between the rake 27 and the first transport element 10.1 is reduced and a section C is increased again. The wear due to abrasion is thereby compensated.

The actuating drive 22 rotates the spindles 21 so as to bring about a desired step-up ratio between the rotation of the actuating drive 22 and the displacement of the mounting plate 20. A controller 40 activates the actuating drive 22. Signals are transmitted to the controller 40 from a range sensor. The controller 40 uses these measurement signals and also a desired quantity in order to calculate the actuating commands at the actuating drive 22.

In a refinement shown in FIG. 2, a range sensor 12.1 measures a distance B between itself and that surface of the driving conveyer belts of the first transport element 10.1 which faces the first retention element 2 and consequently the mail consignments to be separated. For example, the range sensor 12.1 transmits a laser beam through a clearance in the first retention element 2 perpendicularly onto the surface of the first transport element 10.1. The wear of the driving conveyer belts of the first transport element 10.1 increases the distance B. In order to compensate this increase in distance, the mounting plate 20 is moved downward in FIG. 1 or to the left in FIG. 2 toward the first retention element 2 and therefore toward the range sensor 12.1.

In the refinement which is shown in FIG. 2, the range sensor 12.1 therefore measures the distance B directly. The mounting plate 20 is displaced in such a way that this distance remains constant.

One problem in this refinement is that distance measurement becomes difficult or is even impossible when a mail consignment is located between the first transport element 10.1 and the first retention element 2.

In an alternative refinement, it becomes possible to measure a dimension for the wear of the first driving conveyer belt 10.1 permanently, even when a mail consignment between the first driving conveyer belt 10.1 and the first retention element 2 prevents a direct measurement of the distance B. For this purpose, a distance sensor 12.2 is used. For example, the distance sensor 12.2 measures the distance D between the surface of the first driving conveyer belt 10.1 and the range sensor 12.2, specifically in a region in which the first driving conveyer belt of the first transport element 10.1 is guided around the roller 32 and which does not lie opposite the first retention element 2.

Figure 3:
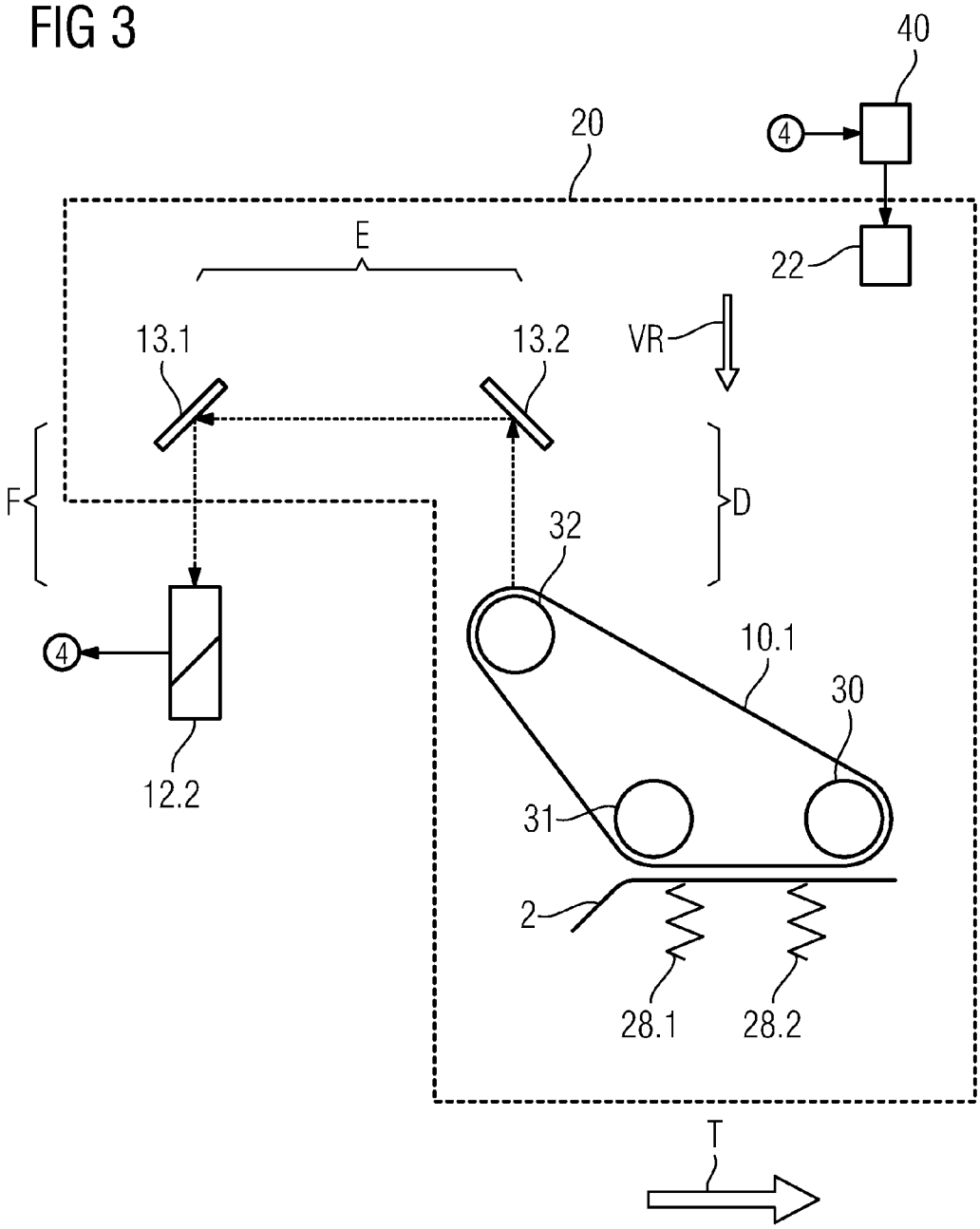
FIG. 3 is an illustration of the first separator of the apparatus of FIG. 1 in a view of a detail with a measuring arrangement.

FIG. 3 shows a preferred embodiment which allows permanent measurement and simple control. In this embodiment, two deflecting mirrors 13.1, 13.2 are used. The constant distance E occurs between the two deflecting mirrors 13.1, 13.2 and the distance F occurs between the range sensor 12.2 and the deflecting mirror 13.1. The distance F varies when the mounting plate 20 is displaced. If the mounting plate 20 is displaced in the displacement direction VR, the distance F decreases. Between the reflecting mirror 13.2 and the surface of the first driving conveyer belt 10.1, the distance D arises, which is increased as a result of the wear of the driving conveyer belts of the first transport element 10.1. The range sensor 12.2 measures the overall distance D+E+F. The range sensor 12.2 preferably delivers a voltage value which is dependent on the measured distance.

The range sensor 12.2 is mounted fixedly. The first transport element 10.1 and the two deflecting mirrors 13.1, 13.2 are mounted on the mounting plate 20 and can thereby be displaced in relation to the range sensor 12.2. The wear of the first transport element 10.1 increases the distance D. Displacement of the mounting plate 20 in the displacement direction VR has an effect that the distance F is reduced. The mounting plate 20 is displaced in such a way that the overall distance D+E+F remains constant. This causes the displacement of the mounting plate 20 to exactly compensate for the wear of the first transport element 10.1.

Particles are also abraded from the surface of the first retention element 2, the result of this being that the first retention element 2 becomes thinner. The action of this effect is preferably compensated by the first retention conveyor belt 2 being pressed against the belt support 18.

Figure 4:
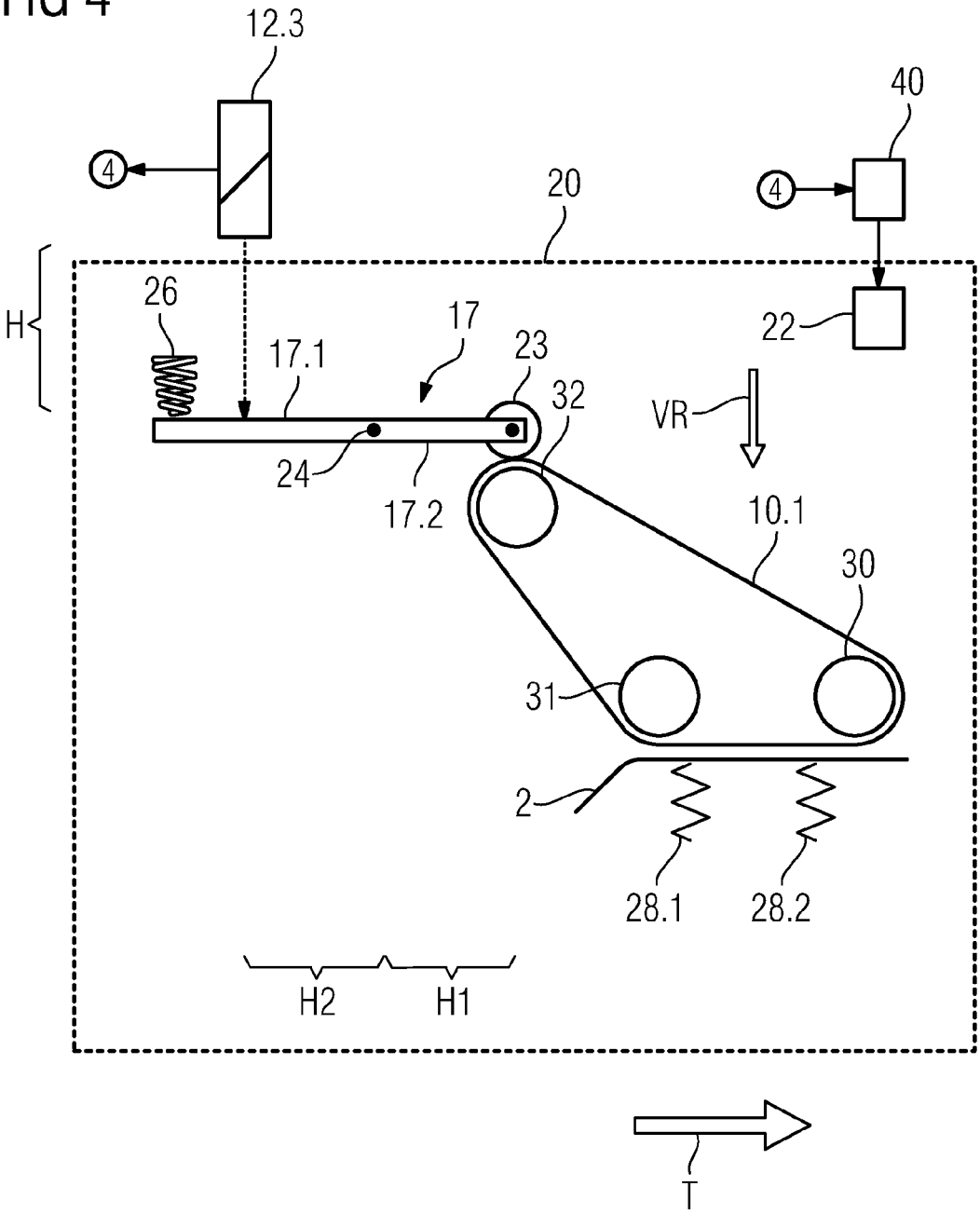
FIG. 4 is an illustration of a detail from FIG. 3 with the measuring arrangement which has a measuring lever.

FIG. 4 shows a third refinement for monitoring and adjusting the first transport element 10.1. This refinement measures a distance by use of at least one measuring lever 17. In the third refinement, the at least one measuring lever 17 is pressed against the surface of a driving conveyer belt of the first transport element 10.1, specifically in the region of the roller 32 and therefore in turn, outside a region in which a mail consignment is located. It is possible that a plurality of measuring levers arranged one above the other are pressed in each case against a driving conveyer belt.

A running roller 23 or a rotatably mounted ball 23 is in constant contact with the surface of the driving conveyer belt. For example, this constant contact is brought about in that the measuring lever 17 is mounted rotatably on an axis 24, and a tension spring 26 draws to itself the free arm 17.1 of the measuring lever 17. The roller or ball 23 is seated at the end of the other arm 17.2 of the measuring lever 17. A range sensor 12.3 measures a distance H between itself and a point of the free arm 17.1 of the measuring lever 17. A reflecting foil or a similar element may be mounted on a surface of the free arm 17.1 of the measuring lever 17, thus making range measurement simpler. The range sensor 12.3 is mounted fixedly, so that the first transport element 10.1, which is mounted on the mounting plate 20, can be displaced in relation to the range sensor 12.3. The surface of the transport element 10.1 can thus be optimized for the separation by drawing apart, and the surface of the measuring lever 17 can be optimized for the measurement of the section length.

The abrasion of particles from the surface of a driving conveyer belt of the first transport element 10.1 causes the driving conveyer belt to become thinner. This, in turn, has the effect that the measuring lever 17 is rotated about the axis 24 and the distance H between the free arm 17.1 and the range sensor 12.3 is thereby varied. In the example of FIG. 4, the measuring lever 17 is rotated clockwise as a result of the wear, and the measured distance H decreases. The decrease in the distance H is proportional to the wear of this driving conveyer belt of the first transport element 10.1. The proportionality factor H1:H2 can be defined by a suitable positioning of the sensor 12.2 in relation to the free arm 17.1. In this case, H1 is the distance between the contact point of the running roller 23 with the first transport element 10.1 and the shaft 24. H2 is the distance between the point of incidence of the range sensor 12.3 and the shaft 24.

Preferably, H1=H2, so that simple control becomes possible. The mounting plate 20 is displaced in the displacement direction VR in such a way that the measured distance H always remains the same.

In the embodiment just described, the first transport element 10.1 is mounted on a displaceable mounting plate 20, and the first retention element 2 is mounted fixedly. The advantage of this refinement is that a mail consignment which is transported by the transport element and bears against the retention element always impinges on to the draw-forward device in the gap between the two transport rollers 3.1, 3.2.

In an alternative embodiment, the first retention element 2 is mounted on the displaceable mounting plate 20, and the first transport element 10.1 is mounted on the fixed base plate 19. In this alternative embodiment, too, the wear of the first transport element 10.1 is measured, specifically as described above, by the range sensor 12.1, 12.2, 12.3. The controller 40 activates the actuating drive 22, and the actuating drive 22 displaces the mounting plate 20 with the first retention element 2 such that the distance between the first retention element 2 and the first transport element 10.1 is reduced. In this way, too, the wear of the first transport element 10.1 is compensated.

The refinement in which the fixed retention element 2 is mounted on the displaceable mounting plate 20 makes it possible to have a mechanically simple set-up, because no driven parts are mounted on the mounting plate 20. However, the draw-forward element 3 has to be readjusted, or a mail consignment does not exactly meet the gap between the two transport rollers 3.1, 3.2.

The invention claimed is:

1. An apparatus for separating flat articles extending in an article plane, the apparatus comprising:

a transport element;

a retention element;

a controller;

a drive for said transport element;

a displaceably mounted base;

an actuating drive for displacing said base;

one of said transport element and said retention element being mounted on said base;

said controller configured for activating said actuating drive such that said actuating drive displaces said base such that a distance between said transport element on said base and said retention element is varied;

the apparatus configured for introducing each of the flat articles to be separated between said transport element and said retention element such an article comes into contact with a surface of said transport element;

said drive configured for driving said transport element such that said transport element is moved in relation to said retention element, and as a result of the relative movement, a drawing apart of at least partially overlapping articles disposed between said transport element and said retention element is brought about;

said transport element configured such that contact between said surface of said transport element and the article to be separated causes abrasion of particles from said surface of said transport element;

a range sensor configured for measuring a length of a section from a fixed point to said surface of said transport element coming into contact with the articles during the drawing apart; and said controller configured for activating said actuating drive in dependence on a measured section length in such a way that said actuating drive displaces said base in such a way that displacement of said base one of completely and at least partially compensates for the abrasion of the particles from said surface of said transport element.

2. The apparatus according to claim 1, wherein said controller is configured for activating said actuating drive such that the displacement, caused by said actuating drive, of said base compensates a variation in the length of the section which said range sensor can measure, in such a way that the length of the section remains unchanged.

3. The apparatus according to claim 2, further comprising two deflecting mirrors including a first deflecting mirror and a second deflecting mirror; and wherein the section, the length of which said range sensor can measure, is formed of two section portions which both run parallel to a displacement direction in which said base is displaceable, said two section portions include a first section portion commencing in said first deflecting mirror and is reduced as a result of the displacement of the said base, and a second section portion commencing in such a surface of said transport element which comes into contact with the articles, and terminates in said second deflecting mirror.

4. The apparatus according to claim 1, the apparatus is configured such that the section, the length of which said range sensor can measure, is disposed completely outside a drawing-apart region in which said transport element and said retention element can draw the articles apart from one another.

5. The apparatus according to claim 1, further comprising a pressure element;

further comprising a measuring lever mounted rotatably, said measuring lever is rotated by said pressure element such that said measuring lever always bears against said surface of said transport element which comes into contact with the articles during the drawing apart; and wherein said range sensor is configured for measuring, as the section, a length of a given section from the fixed point to said measuring lever.

6. The apparatus according to claim 5, wherein:

said measuring lever has two arms including a first arm and a second arm;

said measuring lever is mounted rotatably about an axis of rotation, the axis of rotation delimits said two arms of said measuring lever;

said first arm of said measuring lever bears against said transport element; and said range sensor is configured for measuring, as a section length, the length of the section from a fixed point to second arm being a free arm of said measuring lever.

7. The apparatus according to claim 6, wherein:

said transport elements is mounted on said mounting plate;

the apparatus is configured such that the abrasion of the particles from said surface of said transport element causes a rotation of said measuring lever about the axis of rotation in such a way that, the length of the measured section from the fixed point to said free arm of said measuring lever is reduced; and said controller is configured for activating said actuating drive such that said actuating drive displaces said plate with said transport element in such a way that the length of the section is increased.

8. A method for separating flat articles extending in an article plane, which comprises the steps of:

providing an apparatus having a transport element and a retention element being used for separating the flat articles;

each article to be separated is introduced between the transport element and the retention element such that the article comes temporarily into contact with a surface of the transport element;

moving the transport element in relation to the retention element resulting in a relative movement and as a result of the relative movement a drawing apart of at least partially overlapping articles which are located between the transport element and the retention element is brought about;

displacing a base, on which one of the transport element and the retention element is mounted, such that a distance between the transport element and the retention element is varied, contact between the surface of the transport element and the article to be separated causes abrasion of particles from the surface of the transport element;

measuring a length of a section from a fixed point to the surface of the transport element which comes into contact with the articles during the drawing apart; and displacing the base, on which one of the transport element and the retention element is mounted, in dependence on a measured section length such that a displacement of the base one of completely and at least partially compensates for the abrasion of the particles from the surface of the transport element.

9. The method according to claim 8, which further comprises displacing the base with the transport element such that the displacement compensates a variation in the measured section length.

* * * * *